US005256530A

United States Patent [19]

Bell

[11] Patent Number: 5,256,530

[45] Date of Patent: Oct. 26, 1993

[54] PHOTOGRAPHIC SILVER HALIDE EMULSION CONTAINING CONTRAST IMPROVING GRAIN SURFACE MODIFIERS

[75] Inventor: Eric L. Bell, Webster, N.Y.

[73] Assignee: Eastman Kodak Company, Rochester, N.Y.

[21] Appl. No.: 3,184

[22] Filed: Jan. 12, 1993

[51] Int. Cl.[5] ..... G03C 1/035; G03C 1/09

[52] U.S. Cl. ..... 430/567; 430/604; 430/605

[58] Field of Search ..... 430/567, 604, 605

[56] References Cited

U.S. PATENT DOCUMENTS

| | | | |
|---|---|---|---|
| 2,717,833 | 9/1955 | Wark | 97/07 |
| 3,672,901 | 6/1972 | Ohkubo et al. | 96/94 |
| 3,901,713 | 8/1975 | Yamasue et al. | 96/95 |
| 4,126,742 | 11/1978 | Sakai et al. | 96/110 |
| 4,147,542 | 4/1979 | Habu et al. | 96/27 E |
| 4,828,962 | 5/1989 | Greskowiak et al. | 430/230 |
| 4,835,093 | 5/1989 | Janusonis et al. | 430/567 |
| 4,847,191 | 7/1989 | Greskowiak | 430/605 |
| 4,933,272 | 6/1990 | McDugle et al. | 430/567 |
| 4,937,180 | 6/1990 | Marchetti et al. | 430/567 |
| 4,945,035 | 7/1990 | Keevert et al. | 430/567 |
| 4,981,781 | 1/1991 | McDugle et al. | 430/605 |
| 5,002,866 | 3/1991 | Kashi | 430/567 |
| 5,132,203 | 7/1992 | Bell et al. | 430/567 |

FOREIGN PATENT DOCUMENTS

| | | |
|---|---|---|
| 0325235 | 7/1989 | European Pat. Off. . |
| 0423765 | 4/1991 | European Pat. Off. . |
| 0457298 | 11/1991 | European Pat. Off. . |
| 3274542 | 6/1979 | Japan . |
| 3276152 | 3/1988 | Japan . |
| 1285941 | 3/1989 | Japan . |
| 2234151 | 9/1990 | Japan . |
| 4056846 | 8/1991 | Japan . |
| 554522 | 4/1977 | U.S.S.R. . |
| 1395923 | 5/1975 | United Kingdom . |

*Primary Examiner*—Janet C. Baxter
*Attorney, Agent, or Firm*—Peter C. Cody

[57] ABSTRACT

The present invention provides a photographic silver halide emulsion containing at least two grain surface modifiers. The grain surface modifiers comprise a transition metal complex containing a transition metal chosen from Groups V to X, inclusive, of the periodic table and a nitrosyl or thionitrosyl ligand; and a transition metal selected from Group VIII of the periodic table.

14 Claims, No Drawings

PHOTOGRAPHIC SILVER HALIDE EMULSION CONTAINING CONTRAST IMPROVING GRAIN SURFACE MODIFIERS

FIELD OF THE INVENTION

This invention relates to photographic emulsions. In particular, it relates to photographic silver halide emulsions containing grain surface modifiers and having improved contrast.

BACKGROUND OF THE INVENTION

In both color and black and white photography, there exists the desire for products which exhibit increased contrast upon exposure to light and subsequent development. This desire is based upon the realization that contrast is directly related to the appearance of sharpness; and, it follows, that products which exhibit increased contrast give the visual impression of enhanced sharpness.

Traditionally, photographers have defined contrast by two methods, both of which are derived from the D-log E curve (also known as the "characteristic curve"; see James, *The Theory of Photographic Processes*, 4th ed. pp 501–504). The first method is the determination of $\gamma$, which is defined as the slope of the straight-line section of the D-log E curve. The second is the determination of the overall sharpness of the toe section of the D-log E curve. By sharpness of the toe section, it is usually meant the relative density of the toe section. For instance, a sharp toe corresponds to a relatively low (small) toe density, and a soft toe corresponds to a relatively high (large) toe density. Generally, the point at which toe density is measured corresponds to 0.3 log E fast of the speed point, although toe density may properly be measured at any point prior to the curve's primary increase in slope. The speed point corresponds to the point on the D-log E curve where density equals 1.0.

If either the value of $\gamma$ is high or the toe is sharp, then the image has a relatively high contrast. If the value of $\gamma$ is low or the toe is soft, the image has a relatively low contrast.

It is known that in attempts to maximize the contrast of photographic elements based on silver halide emulsions (as well as other characteristics of the photographic element), the silver halide emulsions have been doped with various transition metal ions and compounds. Dopants are substances added to the emulsion during silver halide precipitation which become incorporated within the internal structure of the silver halide grains. Because they are internally incorporated, they are distinguished from substances added post-precipitation such as chemical or spectral sensitizers. These latter compounds are externally associated with the surface of the silver halide grains and are thus more properly referred to as addenda or grain surface modifiers.

Depending on the level and location of dopants, they may modify the photographic properties of the grains. When the dopants are transition metals which form a part of a coordination complex, such as a hexacoordination complex or a tetracoordination complex, the ligands can also be occluded within the grains, and they too may modify the grain's photographic properties.

Specific examples of doped silver halide emulsions can be found in U.S. Pat. No. 4,147,542, which discloses the use of iron complexes having cyanide ligands; U.S. Pat. Nos. 4,945,035 and 4,937,180 which disclose the use of hexacoordination complexes of rhenium, ruthenium and osmium with at least four cyanide ligands; and U.S. Pat. No. 4,828,962, which discloses the use of ruthenium and iridium ions to reduce high intensity reciprocity failure (HIRF).

Recently, emulsion dopants have been described which comprise transition metal complexes having nitrosyl or thionitrosyl ligands. European Patent Applications 0325235 and 0457298 disclose the use of one such complex, namely potassium ferric pentacyanonitrosyl. A second type of dopant, rhenium nitrosyl or rhenium thionitrosyl is disclosed in U.S. Pat. No. 4,835,093; and a third dicesium pentachloronitrosyl osmate, is disclosed in U.S. Pat. No. 4,933,272.

It has also been known to use combinations of dopants in silver halide emulsions. Such combinations of dopants can be found in U.S. Pat. No. 3,901,713, which discloses the addition of both rhodium and iridium compounds during emulsification or the first ripening; and in U.S. Pat. No. 3,672,901, which teaches the combined use of iron compounds and iridium or rhodium salts.

Methods of improving the photographic characteristics of silver halide emulsions have also consisted of adding transition metals to the emulsions during chemical or spectral sensitization. As mentioned, transition metals added in this manner, because they are added subsequent to silver halide precipitation, are referred to as grain surface modifiers rather than dopants.

The most prevalent chemical sensitizers are the gold and sulfur sensitizers, both of which are thought to enhance emulsion speed by forming electron traps and/or photoholes on the silver halide crystal surface. Sensitization has also been accomplished by the addition of other transition metals. Specifically, platinum salts have been used, although sensitization with such salts is strongly retarded by gelatin. In addition, iridium salts and complex ions of rhodium, osmium, and ruthenium have been used as chemical sensitizers (and also as dopants). The overall effect of these metals on sensitivity appears to be dependant upon their valence state.

Although it is known to employ transition metals, and combinations thereof, as either dopants or grain surface modifiers, prior applications of such transition metals have yielded emulsions exhibiting inferior contrast improvement. This has often been the result of one (or several) dopant or grain surface modifier exerting an insufficient effect. Sometimes, it has been the result of a combination of dopants or grain surface modifiers exerting opposing effects.

Accordingly, it would be desirable to overcome these deficiencies by providing a high contrast silver halide emulsion exhibiting a high $\gamma$ and sharpened toe, wherein a combination of grain surface modifiers imparts the improved contrast characteristic.

SUMMARY OF THE INVENTION

The present invention provides a photographic silver halide emulsion comprising silver halide grains having at least two grain surface modifiers; wherein the first of said grain surface modifiers is a transition metal selected from Group VIII of the periodic table; and wherein the second grain surface modifier is a transition metal complex comprising a nitrosyl or thionitrosyl ligand and a transition metal chosen from Groups V to X, inclusive, of the periodic table.

The combination of grain surface modifiers utilized in accordance with the present invention unexpectedly improves the contrast of the silver halide emulsion. The grain surface modifiers may be added to the emulsion at any stage after silver halide precipitation. As long as they are adsorbed to the surface of the crystal grain, the emulsions will exhibit improved contrast.

In one aspect of the invention, the grain surface modifiers are incorporated onto silver chloride grains that are substantially free of silver iodide or silver bromide. In another aspect, the grain surface modifiers are positioned at intervals along the surface of the silver chloride grains in a silver bromide carrier. The silver bromide carrier, in such instances, accounts for less than about 2 molar percent, and preferably less than about 1 molar percent, of the total silver halide of each crystal.

In these instances, emulsions containing the combination of grain surface modifiers according to this invention exhibit improved contrast.

DETAILED DESCRIPTION OF THE INVENTION

Components of silver halide emulsions are often distinguished by whether they are internally or externally associated with the silver halide crystal grains. Compounds which are added during silver halide precipitation, as mentioned previously, are internally incorporated within the crystal structure, and are thus termed dopants. By contrast, compounds added after precipitation become associated with the external surface of the grains. A variety of terms is used to define these compounds, including addenda and grain surface modifiers.

The present invention concerns such grain surface modifiers and their ability to be used in combination to improve emulsion contrast. The grain surface modifiers are added to the silver halide emulsions during the finishing step. Finishing relates to any procedure performed subsequent to silver halide precipitation whereby substances are added to the emulsion in order to modify the surfaces of the silver halide grains. It therefore includes such procedures as chemical sensitization, spectral sensitization and, in certain circumstances, physical ripening.

Finishing may also include a procedure wherein the grain surface modifiers are positioned at intervals along the surface of the silver halide grains in a silver bromide carrier. The silver bromide carrier, in such instances, accounts for less than about 2, and preferably less than about 1, molar percent of the crystals' total silver halide content.

Finishing in this manner is preferably performed by means of Lippmann bromide carriers. Specifically, a Lippmann bromide emulsion (which is a very fine grain silver bromide emulsion having average grain sizes around 0.05 microns) will have incorporated in its grains certain levels of grain surface modifiers. The grains of the Lippmann bromide emulsion are digested in the presence of the much larger silver halide grains of the present invention. They are then allowed to recrystalize on the surface of the larger grains, thus delivering the grain surface modifiers.

Because the Lippmann bromide carriers account for less than about 2, and preferably less than about 1, molar percent of the total silver halide in the grains, they do not form a shell around the larger grains. Rather, they form deposits at intervals along the surface of the grains. Generally, these deposits will form at the corners of the silver halide grains.

It is also possible to form the emulsions of the present invention by adding the grain surface modifiers alone to a post-precipitation emulsion. However, it is preferred to apply the grain surface modifiers by means of Lippmann bromide carriers which will bind to the surface of the much larger silver halide grains. If Lippmann bromide carriers are not used, and the silver halide grains are predominately silver chloride, it is preferred to apply the grain surface modifiers along with a solution of potassium bromide. As small amounts of the bromide displace chloride molecules on the surface of the silver chloride grain, the grain surface modifiers will tend to be "swept onto" the grain surfaces.

As mentioned, the present invention is concerned with photographic emulsions comprising silver halide grains in which a transition metal complex containing a nitrosyl ligand or a thionitrosyl ligand and a transition metal selected from Groups V to X of the periodic table; and a transition metal selected from Group VIII of the periodic table, serve as grain surface modifiers which improve contrast by sharpening the emulsion's toe and increasing its $\gamma$. To exert their contrast improving effect, both grain surface modifiers must be positioned on the surface of the silver halide grains. Thus, they must be added subsequent to silver halide precipitation.

The preferred transition metal complexes which may be employed as grain surface modifiers in accordance with the present invention can be generically defined by the formula:

$$[TE_4(NZ)E']^r$$

where

T is a transition metal chosen from Groups V to X inclusive of the periodic table, Groups V to X being defined according to the format of the periodic table adopted by the American Chemical Society and published in the *Chemical and Engineering News, Feb.* 4, 1985, p.26.;

Z is oxygen or sulfur, and together with nitrogen forms the nitrosyl or thionitrosyl ligand;

E and E' represent ligands additional to the nitrosyl or thionitrosyl ligand; and r is zero, $-1$, $-2$, or $-3$.

Preferably, T is a transition metal chosen from Group VIII of the periodic table. More preferably, it is chosen from the group consisting of ruthenium and osmium; and optimally, it is osmium.

Specific examples of preferred ligands represented by E include aquo ligands, halide ligands, cyanide ligands, cyanate ligands, thiocyanate ligands, selenocyanate ligands, tellurocyanate ligands, azide ligands, and other nitrosyl or thionitrosyl ligands. The ligand defined above by E' represents either E, nitrosyl or thionitrosyl. The preferred transition metal complexes include:

| | |
|---|---|
| TMC-1 | $[V(NO)(CN)_5]^{-3}$ |
| TMC-2 | $[Cr(NO)(CN)_5]^{-3}$ |
| TMC-3 | $[Mn(NO)(CN)_5]^{-3}$ |
| TMC-4 | $[Fe(NO)(CN)_5]^{-2}$ |
| TMC-5 | $[Ru(NO)Cl_5]^{-2}$ |
| TMC-6 | $[Ru(NO)Br_5]^{-2}$ |
| TMC-7 | $[Ru(NO)I_5]^{-2}$ |
| TMC-8 | $[Ru(NO)F_5]^{-2}$ |
| TMC-9 | $[Ru(NO)Cl_3(H_2O)_2]^0$ |
| TMC-10 | $[Ru(NO)Cl_3(H_2O)]^{-1}$ |
| TMC-11 | $[Ru(NO)Cl_4(OCN)]^{-2}$ |
| TMC-12 | $[Ru(NO)Cl_4(CN)]^{-2}$ |
| TMC-13 | $[Ru(NO)I_4(TeCN)]^{-2}$ |
| TMC-14 | $[Ru(NO)Cl_4(SCN)]^{-2}$ |
| TMC-15 | $[Ru(NO)Br_4(SeCN)]^{-2}$ |

-continued

| | |
|---|---|
| TMC-16 | $[Ru(NO)I_4(SeCN)]^{-2}$ |
| TMC-17 | $[Ru(NO)Cl_3(CN)_2]^{-2}$ |
| TMC-18 | $[Ru(NO)Br_2(CN)_3]^{-2}$ |
| TMC-19 | $[Ru(NO)I_2(CN)_3]^{-2}$ |
| TMC-20 | $[Ru(NO)Cl_4(N)_3]^{-2}$ |
| TMC-21 | $[Ru(NO)Cl(CN)_4]^{-2}$ |
| TMC-22 | $[Ru(NO)Br(SCN)_4]^{-2}$ |
| TMC-23 | $[Ru(NO)I(SCN)_4]^{-2}$ |
| TMC-24 | $[Ru(NO)I(CN)_5]^{-2}$ |
| TMC-25 | $[Os(NO)Cl_5]^{-2}$ |
| TMC-26 | $[Os(NO)Br_5]^{-2}$ |
| TMC-27 | $[Os(NO)I_5]^{-2}$ |
| TMC-28 | $[Os(NO)F_5]^{-2}$ |
| TMC-29 | $[Os(NO)Cl_4(TeCN)]^{-2}$ |
| TMC-30 | $[Os(NO)Br_4(OCN)]^{-2}$ |
| TMC-31 | $[Os(NO)I_4(TeCN)]^{-2}$ |
| TMC-32 | $[Os(NO)Cl_4(SeCN)]^{-2}$ |
| TMC-33 | $[Os(NO)Br_4(SeCN)]^{-2}$ |
| TMC-34 | $[Os(NO)I_4(SeCN)]^{-2}$ |
| TMC-35 | $[Os(NO)Cl_3(CN)_2]^{-2}$ |
| TMC-36 | $[Os(NO)Br_2(CN)_3]^{-2}$ |
| TMC-37 | $[Os(NO)I_2(SCN)_3]^{-2}$ |
| TMC-38 | $[Os(NO)Cl_2(SCN)_3]^{-2}$ |
| TMC-39 | $[Os(NO)Cl(CN)_4]^{-2}$ |
| TMC-40 | $[Os(NO)Br(CN)_4]^{-2}$ |
| TMC-41 | $[Os(NO)I(SCN)_4]^{-2}$ |
| TMC-42 | $[Os(NO)(CN)_5]^{-2}$ |
| TMC-43 | $[Re(NO)(CN)_5]^{-2}$ |
| TMC-44 | $[Re(NO)Cl_5]^{-2}$ |
| TMC-45 | $[Re(NO)Br_5]^{-2}$ |
| TMC-46 | $[Re(NO)Cl_2(CN)_3]^{-2}$ |
| TMC-47 | $[Ir(NO)Cl_5]^{-1}$ |
| TMC-48 | $[Ir(NO)Br_5]^{-1}$ |
| TMC-49 | $[Ir(NO)I_5]^{-1}$ |
| TMC-50 | $[Ir(NO)Cl_3BrI]^{-1}$ |
| TMC-51 | $[Ru(NS)Cl_5]^{-2}$ |
| TMC-52 | $[Os(NS)Br_5]^{-2}$ |
| TMC-53 | $[Ru(NS)I_5]^{-2}$ |
| TMC-54 | $[Os(NS)Cl_4(N_3)]^{-2}$ |
| TMC-55 | $[Ru(NS)Br_4(N_3)]^{-2}$ |
| TMC-56 | $[Os(NS)I_4(N_3)]^{-2}$ |
| TMC-57 | $[Ru(NS)Cl_4(CN)]^{-2}$ |
| TMC-58 | $[Os(NS)Br_4(CN)]^{-2}$ |
| TMC-59 | $[Ru(NS)I_4(CN)]^{-2}$ |
| TMC-60 | $[Os(NS)Cl_4(SCN)]^{-2}$ |
| TMC-61 | $[Ru(NS)Br_4(SCN)]^{-2}$ |
| TMC-62 | $[Os(NS)I_4(SCN)]^{-2}$ |
| TMC-63 | $[Ru(NS)Cl_4(SeCN)]^{-2}$ |
| TMC-64 | $[Os(NS)Br_4(SeCN)]^{-2}$ |
| TMC-65 | $[Ru(NS)I_4(SeCN)]^{-2}$ |
| TMC-66 | $[Os(NS)Cl_3(N_3)_2]^{-2}$ |
| TMC-67 | $[Ru(NS)Br_3(CN)_2]^{-2}$ |
| TMC-68 | $[Os(NS)Cl_3(SCN)_2]^{-2}$ |
| TMC-69 | $[Ru(NS)Cl_3(SeCN)_2]^{-2}$ |
| TMC-70 | $[Ru(NS)Cl_2(N_3)3]^{-2}$ |
| TMC-71 | $[Os(NS)I_2(CN)_3]^{-2}$ |
| TMC-72 | $[Os(NS)Br_2(SCN)_3]^{-2}$ |
| TMC-73 | $[Ru(NS)Cl_2(SeCN)_3]^{-2}$ |
| TMC-74 | $[Ru(NS)Cl_2(N_3)_3]^{-2}$ |
| TMC-75 | $[Os(NS)I_2(CN)_3]^{-2}$ |
| TMC-76 | $[Ru(NS)Br_2(SCN)_3]^{-2}$ |
| TMC-77 | $[Os(NS)Cl_2(SeCN)_3]^{-2}$ |
| TMC-78 | $[Os(NS)Cl(N_3)_4]^{-2}$ |
| TMC-79 | $[Ru(NS)I(CN)_4]^{-2}$ |
| TMC-80 | $[Ru(NS)Cl(SCN)_4]^{-2}$ |
| TMC-81 | $[Os(NS)Cl(SeCN)_4]^{-2}$ |
| TMC-82 | $[Ru(NS)(CN)_5]^{-2}$ |
| TMC-83 | $[Ru(NS)(SCN)_5]^{-2}$ |
| TMC-84 | $[Os(NS)(SeCN)_5]^{-2}$ |
| TMC-85 | $[Ru(NS)(N_3)_5]^{-2}$ |
| TMC-86 | $[Mo(NO)_2(CN)_4]^{-2}$ |

The most preferred transition metal complex is $[Os(NO)Cl_5]^{-2}$; and is associated with a cation, namely $2Cs^{+1}$, to form $Cs_2Os(NO)Cl_5$.

The Group VIII transition metals suitable as the second grain surface modifier are also defined according to the format of the periodic table adopted by the American Chemical Society. Thus, these transition metals comprise iron, ruthenium and osmium. Preferably, the Group VIII transition metals are associated with cyanide ligands. More preferably, they are in a form characterized by the formula:

$$[M(CN)_{6-y}L_y]^n$$

wherein

M is a Group VIII transition metal;

L is a ligand which preferably is a halide, azide, or thiocyanate, though other known ligands are contemplated to be within the scope of invention;

y is zero, 1, 2, or 3; and n is −2, −3, or-4.

Preferred examples of compounds incorporating Group VIII transition metals of the claimed invention include:

| | |
|---|---|
| TMC-87 | $[Ru(CN)_6]^{-4}$ |
| TMC-88 | $[Os(CN)_6]^{-4}$ |
| TMC-89 | $[Fe(CN)_6]^{-4}$ |
| TMC-90 | $[RuF(CN)_5]^{-4}$ |
| TMC-91 | $[OsF(CN)_5]^{-4}$ |
| TMC-92 | $[FeF(CN)_5]^{-4}$ |
| TMC-93 | $[RuCl(CN)_5]^{-4}$ |
| TMC-94 | $[OsCl(CN)_5]^{-4}$ |
| TMC-95 | $[FeCl(CN)_5]^{-4}$ |
| TMC-96 | $[RuBr(CN)_5]^{-4}$ |
| TMC-97 | $[OsBr(CN)_5]^{-4}$ |
| TMC-98 | $[FeBr(CN)_5]^{-4}$ |
| TMC-99 | $[RuI(CN)_5]^{-4}$ |
| TMC-100 | $[OsI(CN)_5]^{-4}$ |
| TMC-101 | $[FeI(CN)_5]^{-4}$ |
| TMC-102 | $[RuF_2(CN)_4]^{-4}$ |
| TMC-103 | $[OsF_2(CN)_4]^{-4}$ |
| TMC-104 | $[FeF_2(CN)_4]^{-4}$ |
| TMC-105 | $[RuCl_2(CN)_4]^{-4}$ |
| TMC-106 | $[OsCl_2(CN)_4]^{-4}$ |
| TMC-107 | $[FeCl_2(CN)_4]^{-4}$ |
| TMC-108 | $[RuBr_2(CN)_4]^{-4}$ |
| TMC-109 | $[OsBr_2(CN)_4]^{-4}$ |
| TMC-110 | $[FeBr_2(CN)_4]^{-4}$ |
| TMC-111 | $[RuI_2(CN)_4]^{-4}$ |
| TMC-112 | $[OsI_2(CN)_4]^{-4}$ |
| TMC-113 | $[FeI_2(CN)_4]^{-4}$ |
| TMC-114 | $[Ru(CN)_5(OCN)]^{-4}$ |
| TMC-115 | $[Os(CN)_5(OCN)]^{-4}$ |
| TMC-116 | $[Fe(CN)_5(OCN)]^{-4}$ |
| TMC-117 | $[Ru(CN)_5(SCN)]^{-4}$ |
| TMC-118 | $[Os(CN)_5(SCN)]^{-4}$ |
| TMC-119 | $[Fe(CN)_5(SCN)]^{-4}$ |
| TMC-120 | $[Ru(CN)_5(N_3)]^{-4}$ |
| TMC-121 | $[Os(CN)_5(N_3)]^{-4}$ |
| TMC-122 | $[Fe(CN)_5(N_3)]^{-4}$ |
| TMC-123 | $[Ru(CN)_5(H_2O)]^{-3}$ |
| TMC-124 | $[Os(CN)_5(H_2O)]^{-3}$ |
| TMC-125 | $[Fe(CN)_5(H_2O)]^{-3}$ |
| TMC-126 | $[Ru(SCN)_6]^{-4}$ |
| TMC-127 | $[Os(SCN)_6]^{-4}$ |
| TMC-128 | $[Fe(SCN)_6]^{-4}$ |
| TMC-129 | $[Ru(OCN)_6]^{-4}$ |
| TMC-130 | $[Os(OCN)_6]^{-4}$ |
| TMC-131 | $[Fe(OCN)_6]^{-4}$ |

Most preferred are $[Fe(CN)_6]^{-4}$ and $[Ru(CN)_6]^{-4}$. Both are added to the emulsion in a form associated with $4K^{+1}$; the iron compound is also associated with three waters of crystalization (hydration).

The grain surface modifiers used in the present invention have provided the best results when positioned along the surface of silver chloride grains which are substantially free of silver iodide or silver bromide. In the preferred embodiment, the silver chloride grains have between about $1.2\times10^{-9}$ and about $24.9\times10^{-9}$ moles of $[Os(NO)Cl_5]^{-2}$ per mole of silver chloride, and between about $2.6\times10^{-6}$ and about $7.9\times10^{-6}$ moles of $[Fe(CN)_6]^{-4}$ or $[Ru(CN)_6]^{-4}$ per mole of silver chloride. In the most preferred embodiment of the invention, $[Os(NO)Cl_5]^{-2}$ is in an amount equal to about $1.2\times10^{-9}$ moles per mole of silver chloride and $[Fe(CN)_6]^{-4}$ or $[Ru(CN)_6]^{-4}$ are in an amount equal to about $7.9\times10^{-6}$ moles per mole of silver chloride.

Silver halide grains capable of being used in the invention are of any known type. They can be formed of bromide ions as the sole halide, chloride ions as the sole halide, or any mixture of the two. They may also incorporate within, minor amounts of iodide ions. Generally, though, iodide concentrations in silver halide grains seldom exceed 20 mole percent and are typically less than 10 mole percent, based on silver. However, specific applications differ widely in their use of iodide. In high speed (ASA 100 or greater) camera films, silver bromoiodide emulsions are employed since the presence of iodide allows higher speeds to be realized at any given level of granularity. In radiography, silver bromide emulsions or silver bromoiodide emulsions containing less than 5 mole percent iodide are customarily employed. Emulsions employed for the graphic arts and color paper, by contrast, typically contain greater than 50 mole percent chloride. Preferably they contain greater than 70 mole percent, and optimally greater than 85 mole percent, chloride. The remaining halide in such emulsions is preferably less than 5 mole percent, and optimally less than 2 mole percent, iodide, with any balance of halide not accounted for by chloride or iodide being bromide.

The advantages of the invention would be present in any of the above-mentioned types of emulsions, although it is preferred that the emulsions comprise silver chloride grains which are substantially free of silver iodide or silver bromide. By substantially free, it is meant that such grains are greater than about 90 molar percent silver chloride. Optimally, silver chloride accounts for about 99 molar percent of the silver halide in the emulsion.

Moreover, the invention may be practiced in black-and-white or color films utilizing any other type of silver halide grains. The grains may be conventional in form such as cubic, octahedral, dodecahedral, or octadecahedral, or they may have an irregular form such as spherical grains or tabular grains. Further, the grains of the present invention may be of the type having <100>, <111>, or other known orientation, planes on their outermost surfaces.

The invention may be further practiced with any of the known techniques for emulsion preparation. Such techniques include those which are normally utilized, for instance single jet or double jet precipitation; or they may include forming a silver halide emulsion by the nucleation of silver halide grains in a separate mixer or first container with later growth in a second container. All of these techniques are referenced in the patents discussed in *Research Disclosure*, December 1989, 308119, Sections I–IV at pages 993–1000.

After precipitation of the silver halide grains, the emulsions containing the grains are washed to remove excess salt. At this time the grain surface modifiers of the present invention may be added to the emulsions, or they may be added at a later time such as during chemical or spectrally sensitization. Both chemical and spectral sensitization may be performed in any conventional manner as disclosed in the above-referenced *Research Disclosure* 308119.

Specific sensitizing dyes which can be used in accordance with the invention include the polymethine dye class, which further includes the cyanines, merocyanines, complex cyanines and merocyanines (i.e. tri-, tetra- and polynuclear cyanines and merocyanines), oxonols, hemioxonols, styryls, merostyryls, and streptocyanines. Other dyes which can be used are disclosed *Research Disclosure* 308119.

Chemical sensitizers which can be used in accordance with the invention include the gold and sulfur class sensitizers, or the transition metal sensitizers as discussed above. Further, they can be combined with any of the known antifoggants or stabilizers such as those disclosed in *Research Disclosure* 308119, Section VI. These may include halide ions, chloropalladates, and chloropalladites. Moreover, they may include thiosulfonates, quaternary ammonium salts, tellurazolines, and water soluble inorganic salts of transition metals such as magnesium, calcium, cadmium, cobalt, manganese, and zinc.

After sensitizing, the emulsions can be combined with any suitable coupler (whether two or four equivalent) and/or coupler dispersants to make the desired color film or print photographic materials; or they can be used in black-and-white photographic films and print material. Couplers which can be used in accordance with the invention are described in *Research Disclosure* Vol. 176, 1978, Section 17643 VIII and *Research Disclosure* 308119 Section VII, the entire disclosures of which are incorporated by reference.

The emulsions of the invention may further be incorporated into a photographic element and processed, upon exposure, by any known method (such as those methods disclosed in U.S. Pat. No. 3,822,129). Typically, a color photographic element comprises a support, which can contain film or paper sized by any known sizing method, and at least three different color forming emulsion layers. The element also typically contains additional layers, such as filter layers, interlayers, overcoat layers, subbing layers, and the like. It may contain brighteners, antistain agents, hardeners, plasticizers and lubricants, as well as matting agents and development modifiers. Specific examples of each of these, and their manners of application, are disclosed in the above-referenced *Research Disclosure* 308119, and *Research Disclosure* 17643.

The invention can be better appreciated by reference to the following specific examples. They are intended to be illustrative and not exhaustive of the emulsions of the present invention and their methods of formation.

EXAMPLES

Emulsion Preparation for Examples 1–9

A silver chloride emulsion (Emulsion S) of 0.74 micron cubic edge length was prepared in accordance with the conventional techniques disclosed above and washed to remove excess salts. In addition, a series of Lippmann bromide carriers was prepared for the addition of two grain surface modifiers—$Os(NO)Cl_5$ and $Fe(CN)_6$—to Emulsion S. Preparation of the Lippmann bromide carriers was as follows:

Emulsion L-1: A reaction vessel containing 4.0 liters of a 5.6 percent by weight gelatin aqueous solution was adjusted to a temperature of 40° C., pH of 5.8, and pAG of 8.86 by addition of AgBr solution. A 2 5 molar solution containing 1698.7 grams of $AgNO_3$ in water and a 2.5 molar solution containing 1028.9 grams of NaBr in water were simultaneously run into the reaction vessel with rapid stirring, each at a constant flow rate of 200 ml/min. The double jet precipitation continued for 3 minutes at a controlled pAg of 8.86, after which the double jet precipitation was continued for 17 minutes. During this time the pAg decreased linearly from 8.86 to 8.06. A total of 10 moles of silver bromide (Lippmann bromide) was precipitated, the silver bromide having average grain sizes of 0.05 microns.

Emulsion L-2 was prepared exactly as Emulsion L-1 except a solution of 0.011 grams of $Cs_2Os(NO)Cl_5$ in 25 ml water was added at a constant flow rate during precipitation of the Lippmann bromide carriers. This triple jet precipitation produced 10 moles of a 0.05 micron particle diameter emulsion.

Emulsion L-3 was prepared exactly as Emulsion L-1 except a solution of 0.11 grams of $Cs_2Os(NO)Cl_5$ in 25 ml water was added at a constant flow rate during precipitation of the Lippmann bromide carriers. This triple jet precipitation produced 10 moles of a 0.05 micron particle diameter emulsion.

Emulsion L 4 was prepared exactly as Emulsion L-1 except 14.78 grams of $K_4Fe(CN)_6.(3H2O)$ was added to the NaBr solution during the initial 35% of the Lippmann bromide precipitation. This double jet precipitation produced 10 moles of a 0.05 micron particle diameter emulsion.

EXAMPLES 1 -9

Application of the grain surface modifiers—$Os(NO)Cl_5$ and $Fe(CN)_6$—to the silver halide grains of the invention was as follows: Example 1 was prepared by heating a 50 millimole (mmole) sample of unfinished Emulsion S to 40° C., and spectrally sensitizing it by conventional methods. Then, 0.45 mmoles of Emulsion L-1 were added to Emulsion S, as well as, appropriate amounts of sodium thiosulfate and 4-hydroxy-6-methyl-1,3,3*a*,7-tetraazaindene. The emulsion was heated to 60° C. for 20–70 minutes until optimal chemical sensitization was achieved. Addition of 1-(3-acetamidophenyl)-5-mercaptotetrazole followed to complete finishing.

Example 2 was prepared in the same manner as Example 1 except that 0.056 mmoles of Emulsion L-4 and 0.394 mmoles of Emulsion L-1 were added instead of 0.45 mmoles of Emulsion L 1.

Example 3 was prepared in the same manner as Example 1 except that 0.169 mmoles of Emulsion L-4 and 0.281 mmoles of Emulsion L-1 were added instead of 0.45 mmoles of Emulsion L-1.

Example 4 was prepared in the same way as Example 1 except that 0.056 mmoles of Emulsion L-2 and 0.394 mmoles of Emulsion L-1 were added instead of 0.45 mmoles of Emulsion L-1.

Example 5 was prepared in the same way as Example 1 except that 0.056 mmoles of Emulsion L 2, 0.056 mmoles of Emulsion L 4 and 0.338 mmoles of Emulsion L-1 were added instead of 0.45 mmoles of Emulsion L-1.

Example 6 was prepared in the same way as Example 1 except that 0.056 mmoles of Emulsion L 2, 0.169 mmoles of Emulsion L-4 and 0.225 mmoles of Emulsion L 1 were added instead of 0.45 mmoles of Emulsion L-1.

Example 7 was prepared in the same way as Example 1 except that 0.112 mmoles of Emulsion L-3 and 0.338 mmoles of Emulsion L-1 were added instead of 0.45 mmoles of Emulsion L-1.

Example 8 was prepared in the same way as Example 1 except that 0.112 mmoles of Emulsion L-3, 0.056 mmoles of Emulsion L-4 and 0.282 mmoles of Emulsion L-1 were added instead of 0.45 mmoles of Emulsion L-1.

Example 9 was prepared in the same way as Example 1 except that 0.112 mmoles of Emulsion L-3, 0.169 mmoles of Emulsion L-4 and 0.169 mmoles of Emulsion L-1 were added instead of 0.45 mmoles of Emulsion L-1.

All emulsions were coated on paper support that had been sized using the sizing methods disclosed in U.S. Pat. No. 4,994,147. Coating was at 0.28 grams/$m^2$ silver with 0.002 grams/$m^2$ silver of 2,4-dihydroxy-4-methyl-1-piperidinocyclopenten-3-one, 0.02 grams/$m^2$ of KCl, and 1.08 grams/$m^2$ yellow forming coupler added to give a layer with 0.166 grams/$m^2$ gelatin. A 1.1 grams/$m^2$ gelatin protective overcoat layer was applied along with a vinylsulfone gelatin hardener.

The coatings were exposed through a step tablet to a 3000K light source for 0.1 second and processed as recommended in "Using KODAK EKTACOLOR RA Chemicals", Publication No. Z-130, published by Eastman Kodak Co., 1990.

The results are shown in Table 1 and correspond to sensitometric data points on each emulsions D-log E curve. To assist in understanding these results, and hence the invention, particular attention is drawn to Examples 1, 3, 4 and 6. Example 1 corresponds to an emulsion having no grain surface modifiers. Its 0.3 toe value is 0.397 and its gamma is 2.87. When a single grain surface modifier is added to this emulsion, as in Examples 3 or 4, toe value and gamma are changed. If $7.9\times10^{-6}$ moles of $Fe(CN)_6$ per mole of silver chloride are added (Example 3), overall contrast remains roughly the same, as gamma decreases and toe, particularly 0.3 toe, sharpens (smaller value) slightly. If, on the other hand, $1.2\times10^{-9}$ moles of $Os(NO)Cl_5$ per mole of silver chloride are added to the 0 emulsion instead of $Fe(CN)_6$ (Example 4) contrast increases substantially as both toe sharpens (smaller value) and gamma increases.

The invention resides in an emulsion containing the combination of grain surface modifiers. As can be seen from Example 6, such an emulsion exhibits a very large contrast increase. Toe density, for instance, is much sharper with the combination of grain surface modifiers than with either one alone, or even the additive effects of both together. Similarly, gamma is much higher with the combination of grain surface modifers.

This analysis may be used to understand the remaining results in Table 1, as well as the results in the following Examples. Further understanding of the invention may be garnered by the reference to the columns labeled "% Toe change". The values in these columns correspond to the change in toe from an unmodified emulsion (i.e. Example 1), and they illustrate that emulsions containing the combination of grain surface modifiers exhibit the greatest contrast improvement.

TABLE 1

| Example | | Grain Surface Modifiers Fe(CN)[1] | Os(NO)[2] | Speed[3] | 0.5 Toe[4] | 0.3 Toe[5] | Gamma[6] | 0.1 Second Exposure 0.5% Toe Change | 0.3% Toe Change |
|---|---|---|---|---|---|---|---|---|---|
| 1 | control | 0 | 0 | 159 | 0.186 | 0.397 | 2.87 | — | — |
| 2 | " | 2.6 | 0 | 172 | 0.175 | 0.390 | 2.62 | −6.9 | −1.8 |
| 3 | " | 7.9 | 0 | 185 | 0.158 | 0.380 | 2.76 | −15.0 | −4.3 |
| 4 | " | 0 | 1.2 | 155 | 0.142 | 0.340 | 3.18 | −23.7 | −14.4 |
| 5 | invention | 2.6 | 1.2 | 165 | 0.119 | 0.310 | 3.16 | −36.0 | −21.9 |
| 6 | " | 7.9 | 1.2 | 170 | 0.079 | 0.250 | 3.31 | −57.5 | −37.0 |
| 7 | control | 0 | 24.9 | 91 | 0.077 | 0.190 | 5.20 | −58.6 | −52.1 |
| 8 | invention | 2.6 | 24.9 | 90 | 0.160 | 0.069 | 5.98 | −62.9 | −59.7 |
| 9 | " | 7.9 | 24.9 | 81 | 0.040 | 0.060 | 7.66 | −78.5 | −84.9 |

[1]Molar part per million $Fe(CN)_6$/mole AgCl; incorporated 0–35% of the Lippmann bromide emulsion grain (by volume)
[2]Molar part per million $Os(NO)Cl_5$/mole AgCl; incorporated 0–100% of the Lippmann bromide emulsion grain (by volume)
[3]The reciprocal of the relative amount of light in Log E × 100 to produce 1.0 density
[4]The density value of the point 0.5 log E fast of the speed point
[5]The density value of the point 0.3 log E fast of the speed point
[6]Slope of a line tangent to the sensitometric curve at the speed point.

Emulsion Preparation for Examples 10–18

A silver chloride emulsion (Emulsion S) of 0.74 micron cubic edge length was prepared in accordance with the conventional techniques disclosed above and washed to remove excess salts. An additional Lippmann bromide carrier (Emulsion L-5) was prepared for the addition of $Ru(CN)_6$ as a grain surface modifier during finishing of Emulsion S. Preparation of the additional Lippmann bromide carrier was exactly as the preparation of Emulsion L-1 except that 14.48 grams of $K_4Ru(CN)_6$ were added to the NaBr solution during the initial 35% of the Lippmann bromide precipitation. This double jet precipitation produced 10 moles of a 0.05 micron particle diameter emulsion.

EXAMPLES 10–18

Application of the grain surface modifiers—$Os(NO)Cl_5$ and $Ru(CN)_6$—to the silver halide grains of the invention was as follows:

Example 10, was prepared according to procedures described for Example 1.

Example 11 was prepared in the same way as Example 1 except 0.056 mmoles of Emulsion L-5 and 0.394 mmoles of Emulsion L-1 were added instead of 0.45 mmoles of Emulsion L 1.

Example 12 was prepared in the same way as Example 1 except 0.169 mmoles of Emulsion L-5 and 0.281 mmoles of Emulsion L-1 were added instead of 0.45 mmoles of Emulsion L-1.

Example 13 was prepared in the same way as Example 4.

Example 14 was prepared in the same way as Example 1 except 0.056 mmoles of Emulsion L 2, 0.056 mmoles of Emulsion L-5 and 0.338 mmoles of Emulsion L-1 were added instead of 0.45 mmoles of Emulsion L-1.

Example 15 was prepared in the same way as Example 1 except 0.056 mmoles of Emulsion L 2, 0.169 mmoles of Emulsion L-5 and 0.225 mmoles of Emulsion L 1 were added instead of 0.45 mmoles of Emulsion L-1.

Example 16 was prepared in the same way as Example 1 except 0.056 mmoles of Emulsion L-3 and 0.394 mmoles of Emulsion L-1 were added instead of 0.45 mmoles of Emulsion L-1.

Example 17 was prepared in the same way as Example 1 except 0.056 mmoles of Emulsion L 3, 0.056 mmoles of Emulsion L-5 and 0.338 mmoles of Emulsion L 1 were added instead of 0.45 mmoles of Emulsion L-1.

Example 18 was prepared in the same way as Example 1 0.056 mmoles of Emulsion L 3, 0.169 mmoles of Emulsion L-5 and 0.225 mmoles of Emulsion L-1 were added instead of 0.45 mmoles of Emulsion L-1.

All emulsions were coated on paper support that had been sized using the sizing methods disclosed in U.S. Pat. No. 4,994,147 and processed in a manner similar to Examples 1–9. The results are shown in Table 2 and correspond to sensitometric data points on each emulsions D-log E curve. The results illustrate the increased contrast according to the present invention can be obtained with ruthenium hexacyanide in place of ferrous hexacyanide.

TABLE 2

| Example | | Grain Surface Modifiers Ru(CN)[1] | Os(NO)[2] | Speed[3] | 0.5 Toe[4] | 0.3 Toe[5] | Gamma[6] | 0.1 Second Exposure 0.5% Toe Change | 0.3% Toe Change |
|---|---|---|---|---|---|---|---|---|---|
| 10 | control | 0 | 0 | 156 | 0.206 | 0.416 | 2.80 | — | — |
| 11 | " | 2.6 | 0 | 168 | 0.199 | 0.409 | 2.54 | −3.4 | −1.7 |
| 12 | " | 7.9 | 0 | 182 | 0.182 | 0.403 | 2.56 | −11.7 | −3.1 |
| 13 | " | 0 | 1.2 | 151 | 0.150 | 0.357 | 2.97 | −27.2 | −14.2 |
| 14 | invention | 2.6 | 1.2 | 160 | 0.128 | 0.323 | 3.20 | −37.9 | −22.6 |
| 15 | " | 7.9 | 1.2 | 167 | 0.089 | 0.245 | 3.33 | −56.8 | −41.1 |
| 16 | control | 0 | 12.4 | 117 | 0.138 | 0.261 | 4.24 | −33.0 | −37.3 |
| 17 | invention | 2.6 | 12.4 | 125 | 0.080 | 0.192 | 4.79 | −61.2 | −53.8 |

TABLE 2-continued

| Example | | Grain Surface Modifiers Ru(CN)[1] | Os(NO)[2] | Speed[3] | 0.5 Toe[4] | 0.3 Toe[5] | Gamma[6] | 0.1 Second Exposure 0.5% Toe Change | 0.3% Toe Change |
|---|---|---|---|---|---|---|---|---|---|
| 18 | " | 7.9 | 12.4 | 118 | 0.060 | 0.102 | 5.81 | −70.9 | −75.5 |

[1]Molar part per million $Ru(CN)_6$/mole AgCl; incorporated 0–35% of the Lippmann bromide emulsion grain (by volume)
[2]Molar part per million $Os(NO)Cl_5$/mole AgCl; incorporated 0–100% of the Lippmann bromide emulsion grain (by volume)
[3]The reciprocal of the relative amount of light in Log E × 100 to produce 1.0 density
[4]The density value of the point 0.5 log E fast of the speed point
[5]The density value of the point 0.3 log E fast of the speed point
[6]Slope of a line tangent to the sensitometric curve at the speed point.

The invention has been described in detail with particular reference to preferred embodiments thereof, but it will be understood that variations and modifications can be effected within the spirit and scope of the invention.

What is claimed is:

1. A photographic silver halide emulsion comprising silver halide grains having at least two grain surface, modifiers; wherein, the first of said grain surface modifiers is a transition metal complex containing a transition metal selected from Group VIII of the periodic table; and wherein the second grain surface modifier is a transition metal complex comprising a nitrosyl or thionitrosyl ligand and a transition metal chosen from Groups V to X, inclusive, of the periodic table.

2. A photographic emulsion according to claim 1 wherein said silver halide grains contain silver chloride and are substantially free of silver iodide or silver bromide.

3. A photographic emulsion according to claim 2 wherein the grain surface modifiers are positioned at intervals along the surface of said silver chloride grains in a silver bromide carrier, said silver bromide carrier accounting for less than about 2 molar percent of said silver halide grain.

4. A photographic emulsion according to claim 3 wherein said silver bromide carrier accounts for less than about 1 molar percent of said silver halide grain.

5. A photographic emulsion according to claim 4 wherein said first grain surface modifier contains cyanide ligands.

6. A photographic emulsion according to claim 5 wherein said first grain surface modifier is in the formula:

$$[M(CN)_{6-y}Ly]^n$$

where

M is a Group VIII transition metal,

L is a ligand, y is zero, 1, 2, or 3, and n is −2, −3, or −4; and wherein said second grain surface modifier has the formula:

$$[TE_4(NZ)E']^r$$

where

T is a transition metal chosen from Groups V to X, inclusive, of the periodic table, Z is oxygen or sulfur, and together with nitrogen forms the nitrosyl or thionitrosyl ligand, E and E′ represent ligands, and r is zero, −1, −2, or −3.

7. A photographic emulsion according to claim 6 wherein said first grain surface modifier is in the form of $[Fe(CN)_6]^{-4}$; and said second grain surface modifier is $[Os(NO)Cl_5]^{-2}$.

8. A photographic emulsion according to claim 7 wherein said silver chloride grains have between about $2.6\times10^{-6}$ and about $7.9\times10^{-6}$ moles of $[Fe(CN)_6]^{-4}$ per mole of silver chloride, and between about $1.2\times10^{-9}$ and about $2.49\times10^{-8}$ moles of $Os(NO)Cl_5]^{-2}$ per mole of silver chloride.

9. A photographic emulsion according to claim 8 wherein said silver chloride grains have $1.2\times10^{-9}$ moles of $[Os(NO)Cl_5]^{-2}$ per mole of silver chloride, and $7.9\times10^{-6}$ moles of $[Fe(CN)_6]^{-4}$ per mole of silver chloride.

10. A photographic emulsion according to claim 6 wherein said first grain surface modifier is in the form of $Ru(CN)_6]^{-4}$; and said second grain surface modifier is $[Os(NO)Cl_5]^{-2}$.

11. A photographic emulsion according to claim 10 wherein said silver chloride grains have between about $2.6\times10^{-6}$ and about $7.9\times10^{-6}$ moles of $Ru(CN)_6]^{-4}$ per mole of silver chloride, and between about $1.2\times10^{-9}$ and about $2.49\times10^{-8}$ moles of $Os(NO)Cl_5]^{-2}$ per mole of silver chloride.

12. A photographic emulsion according to claim 11 wherein said silver chloride grains have $7.9\times10^{-6}$ moles of $[Ru(CN)_6]^{-4}$ per mole of silver chloride, and $1.2\times10^{-9}$ moles of $[Os(NO)Cl_5]^{-2}$ per mole of silver chloride.

13. A photographic silver halide emulsion comprising silver chloride grains substantially free of silver iodide or silver bromide; said silver chloride grains having associated thereon at least two grain surface modifiers; wherein said grain surface modifiers comprise an transition metal complex, having nitrosyl or thionitrosyl ligands and a transition metal chosen from Groups V to X, inclusive, of the periodic table; and a transition metal complex containing a transition metal selected from the group consisting of iron and ruthenium.

14. A photographic silver halide emulsion comprising silver halide grains wherein said silver halide grains are modified subsequently to their formation by at least two grain surface modifiers, said grain surface modifiers being transition metal complexes and comprising a transition metal selected from Groups V to X, inclusive, of the periodic table, and a nitrosyl or thionitrosyl ligand; and a cyanide ligand with a transition metal selected from Group VIII of the periodic table.

* * * * *